US005456614A

United States Patent [19]

Szegda

[11] Patent Number: 5,456,614

[45] Date of Patent: Oct. 10, 1995

[54] COAXIAL CABLE END CONNECTOR WITH SIGNAL SEAL

[75] Inventor: Andrew Szegda, Canastota, N.Y.

[73] Assignee: John Mezzalingua Assoc., Inc., Manlius, N.Y.

[21] Appl. No.: 186,672

[22] Filed: Jan. 25, 1994

[51] Int. Cl.[6] ..... H01R 13/639

[52] U.S. Cl. ..... 439/321; 439/315

[58] Field of Search ..... 439/320, 321, 439/322, 315, 489

[56] References Cited

U.S. PATENT DOCUMENTS

| | | | |
|---|---|---|---|
| 2,822,418 | 2/1958 | Dinnick | 439/320 |
| 3,673,547 | 6/1972 | Ziegler | 285/354 |
| 4,557,546 | 12/1985 | Dreyer | 439/320 |
| 4,990,106 | 2/1991 | Szegda | 439/585 |
| 5,123,793 | 6/1992 | Bonstein | 411/310 |

FOREIGN PATENT DOCUMENTS

| | | | |
|---|---|---|---|
| 052971A2 | 6/1982 | European Pat. Off. | 439/322 |

*Primary Examiner*—Mark Rosenbaum
*Assistant Examiner*—Jeffrey T. Knapp
*Attorney, Agent, or Firm*—Samuels, Gauthier & Stevens

[57] ABSTRACT

A coaxial cable end connector includes a tubular post having a first flange at a front end thereof and a port fastener rotatably supported on the front end of the post, the fastener having a second flange adapted to coact in mechanical interengagement with the first flange. The first and second flanges establish a non-planar interface of interengagement which acts as a signal seal in response to being interengaged. The first flange includes a surface indentation which coacts with a surface protuberance of the second flange in response to the fastener being connected to a signal port. In addition, an interference protuberance associated with the fastener coacts with an inclined surface associated with the tubular body to establish another non-planar interface of interengagement which acts as an additional signal seal. In a further embodiment, the port fastener includes a coupling nut with an internally threaded surface having an undersized thread portion proximate to the first and second flanges, such that the enlarged thread creates a locking effect and enhances the signal seal as the port fastener is threaded onto the signal port.

21 Claims, 1 Drawing Sheet

COAXIAL CABLE END CONNECTOR WITH SIGNAL SEAL

BACKGROUND OF THE INVENTION

The invention relates to end connectors used to connect cables to equipment ports, terminals or the like. The invention is particularly useful in, although not limited to, end connectors for coaxial cables in the cable television industry.

The conventional coaxial cable usually consists of a centrally located inner electrical conductor surrounded by and spaced inwardly from an outer electrical conductor. A dielectric insulator is interposed between the inner and outer conductors, with the outer conductor being surrounded by a protective dielectric jacket. The outer conductor can comprise a sheath of fine braided metallic strands, a metallic foil, or multiple layer combinations of either or both.

The conventional end connector is generally tubular in configuration, with a front end including a coupling nut which is adapted to attach to equipment ports or terminals, and with a rear end adapted to receive and attach to the cable.

Other connectors are adapted to push on rather than thread on the signal ports, have been presented. These push on type end connectors typically utilize a split ferrule configuration which includes a plurality of resilient fingers that enable relatively easy connection and disconnection of the end connector to the signal port. The split ferrule may be provided with a surrounding locking sheath which enhances the connection to the signal port.

Examples of such end connectors are described in U.S. Pat. Nos. 4,990,106, 5,073,129, and 5,195,906, of common assignee, and incorporated herein by reference.

Certain disadvantages relating to signal loss may be associated with end connectors that use the coupling nut. The mechanical interengagement between the coupling nut with the other components of the end connector are typically configured with coacting flat surfaces that allow for slight signal loss. For example, the coupling nut includes a flange which is rotatably supported by an opposing flange associated with a post arrangement. Ideally, the interactive surfaces of these flanges are brought into close contact with one another when the coupling nut is threaded onto the signal port. However, the coupling nut is often not properly or completely connected to the signal port, thus leaving a space which accommodates signal loss. In addition, the tolerances in manufacturing the flange surfaces may be less than ideal, which also provides paths for signal loss.

The standard sized threads associated with both the coupling nut and the signal port inherently have low reverse holding power. The threaded components, without the aid of specific locking devices, can be tightened to a point of creating a holding pressure between the mating threads. The tightening action is in an axial direction, thus the flat surfaces of the threads mate with one another as the connector components are drawn together. However, the high axial forces required to provide holding pressures can damage or destroy the threads of either the coupling nut or the signal port. Furthermore, extreme vibrations and temperature variations, as well as craftsmanship errors, may also cause the coupling nut to loosen from the signal port. Due to this loosening, signals normally entrapped within the connector begin leaking through opened crevices, thus escaping and creating interference with signal transmissions.

The principal objective of the present invention is to provide an improved end connector designed to ensure precise port connections which eliminate signal loss.

It is another object of the present invention to provide an end connector with a coupling nut which produces a high reverse or loosening force while protecting the connector and port components.

It is a further object of the present invention to provide a signal seal and locking effect with components of an end connector with the use of surface interferences between adjacent components.

SUMMARY OF THE INVENTION

Accordingly, the present invention provides a coaxial cable end connector including a tubular post having a first flange at a front end thereof and a cylindrical sleeve at a rear end thereof; a tubular body supported on the front end of the post at a location adjacent to the first flange, the body defining a chamber which surrounds the cylindrical sleeve and which is adapted to engage a coaxial cable; a port fastener rotatably supported on the front end of the post, the fastener having a second flange adapted to coact in mechanical interengagement with the first flange; and means associated with the first and second flanges for establishing a non-planar interface of interengagement which acts as a signal seal in response to the first and second flanges being interengaged.

According to an alternative embodiment, means associated with said port fastener and said tubular body are provided for establishing a second non-planar interface of interengagement which acts as a signal seal in response to the port fastener being coupled to the signal port.

In a further embodiment of the present invention, the port fastener of the end connector includes a coupling nut with an internally threaded surface, the internally threaded surface including undersized threads proximate to the first and second flanges, such that the undersized threads create a locking effect and enhances the signal seal as the port fastener is threaded onto a signal port. In addition, the internally threaded surface are broached so as to provide a further interference fit with the threads of the signal port.

DETAILED DESCRIPTION OF THE ILLUSTRATED EMBODIMENTS

Figure 1:
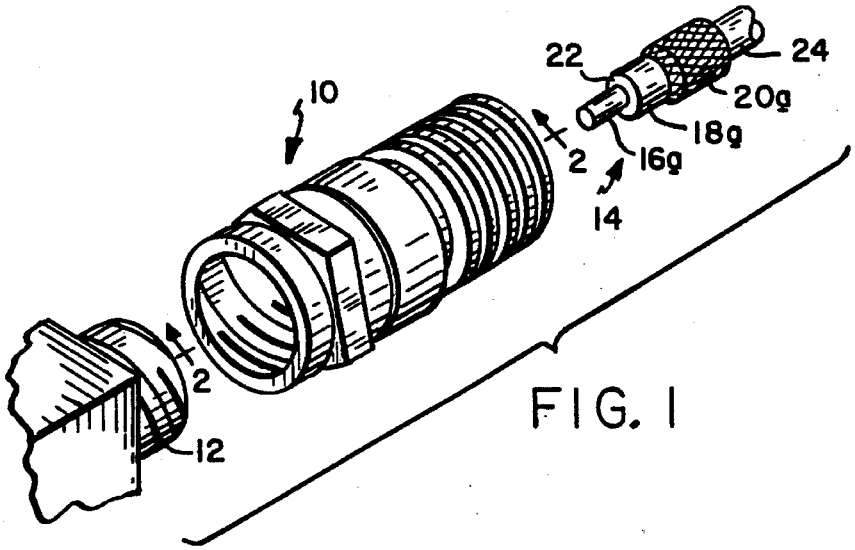
FIG. 1 is a perspective view showing a conventional signal port, an end connector in accordance with the present invention, and end of a conventional coaxial cable which has been prepared for insertion into the end connector.
Figure 2:
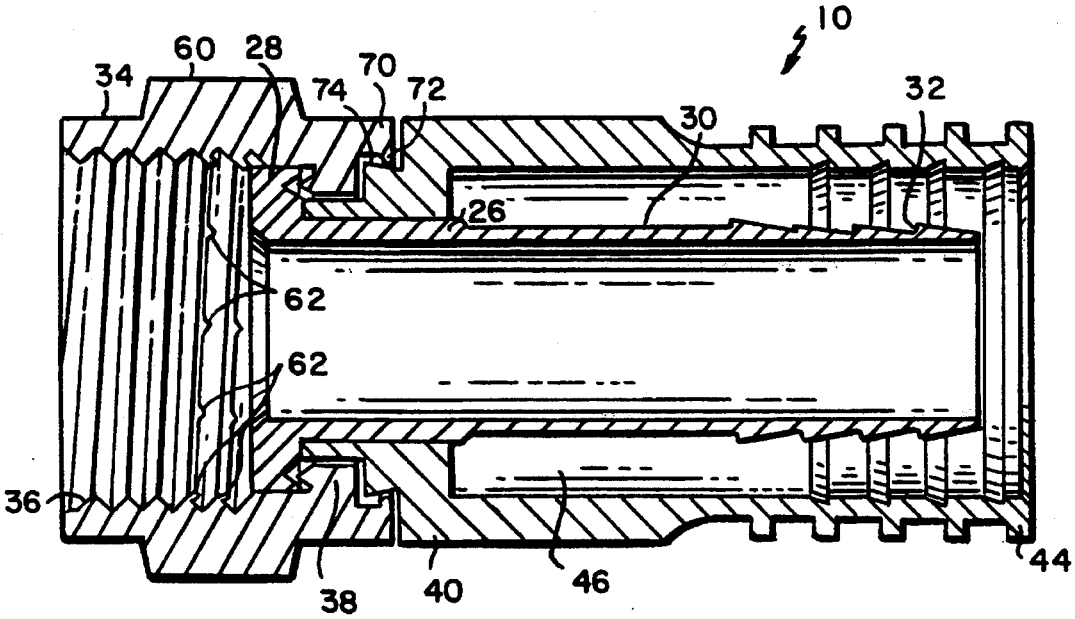
FIG. 2 is an enlarged sectional view of the end connector of FIG. 1 taken along line 2—2.

With reference now to FIG. 1, an end connector 10 in accordance with the present invention is shown between a conventional externally threaded equipment port 12 and an end of a conventional coaxial cable 14 which has been prepared to receive the end connector.

In the example herein selected for illustrative purposes, the cable 14 includes an electrical inner conductor 16 surrounded by and spaced inwardly from an electrical outer conductor comprising a layer of metallic foil directly underlying a layer of braided metallic mesh 20. The inner and outer conductors are electrically isolated one from the other by a dielectric insulator 22 interposed therebetween. A dielectric protective covering or jacket 24 surrounds the outer conductor.

The end of the cable is prepared for coupling with the end connector by first removing a portion of the jacket 24 to thereby expose an end segment 20*a* of the braided metallic mesh. The exposed end segment of mesh is then folded back over the jacket as illustrated in the drawings, thus exposing an end segment 18*a* of the metallic foil. Thereafter, a shorter portion of the exposed metallic foil segment 18*a* and the underlying dielectric insulator 22 are removed to thereby expose an end segment 16*a* of the inner conductor.

The end connector 10 of the present invention comprises an inner tubular post 26 having a first flange 28 at a front end thereof and a cylindrical first sleeve 30 at a rear end thereof. The cylindrical sleeve may be provided with a series of circular serrations 32.

A port fastener 34 in the form of a coupling nut is rotatably received and supported on the front end of the post 26. The fastener is internally threaded as at 36, and is provided with a second flange 38 arranged to coact in mechanical interengagement with the first flange 28 on the post 26.

A tubular body 40 is supported on the front end of the post 26 at a location adjacent to the first flange 28. An optional O-ring seal, for outdoor applications, is interposed between the tubular body 40 and the fastener 34, and a cylindrical second sleeve 44 extends rearwardly from the tubular body 40. The second sleeve 44 surrounds and is spaced radially from the first sleeve 30 of the post 28 to thereby define an annular chamber 46 therebetween. The second sleeve 44 has an open rear end leading to the annular chamber 46. The entire configuration described is adapted to receive and retain the prepared cable by a crimping operation.

Due to manufacturing tolerances, a space exists between the post 26 and the fastener 34. This space may increase on one side or the other during the tightening process, thus creating a potential signal leakage path.

Figure 3:
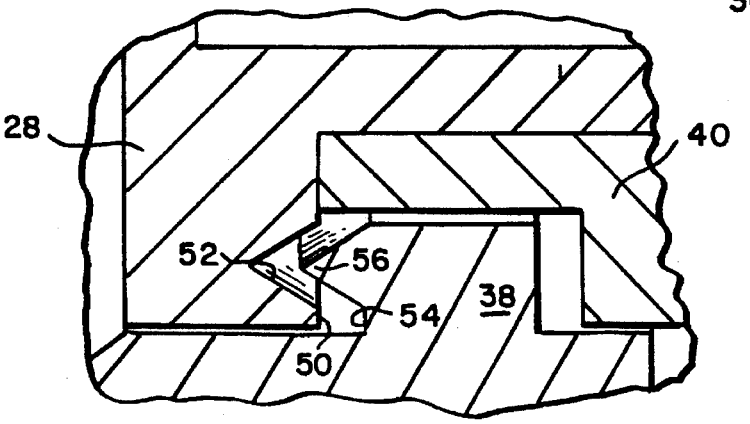
FIG. 3 is a blown up view of the signal seal of the present invention.

With reference now to FIG. 3, the signal seal of the present invention is illustrated. The first flange 28 of the post 26 includes a surface 50 having a surface indentation 52. The surface indentation 52 may take the form of a notched channel which runs around the entire circumference of the surface 50. The second flange 38 of the fastener 34 includes a surface 54 having a surface protuberance 56. The surface protuberance 56 may take the form of an extended ridge which is disposed about the entire circumference of the surface 54.

In operation, the protuberance 56 is received within the indentation 52 as the fastener 34 is threaded onto the signal port so as to create a non-planar interface of interengagement between the flanges. The configuration of the coacting protuberance and indentation allow for continual rotational movement between the flange surfaces. However, the interengagement of the protuberance 56 and the indentation 52 serves as a signal seal due to the disruption of any signal leakage path existing between the flange surfaces.

It will be appreciated by those of skill in the art that a similar signal seal involving flange surfaces with interacting surface protuberances and indentations may be utilized in twist-on type end connectors which utilize an outer locking sheath as described in U.S. Pat. No. 5,195,906, of common assignee.

Figure 4:
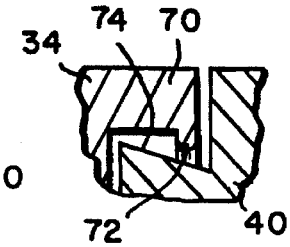
FIG. 4 is a blown up view of an alternative embodiment of the signal seal of the present invention.

In addition, a secondary interference signal seal is provided as shown in FIG. 4. A rear portion 70 of the fastener 34 is provided with an interference protrusion 72 which abuts an inclined interference surface 74 associated with the tubular body 40. In operation, as the fastener is threaded onto the signal port 12, the interference protrusion 72 is drawn upward along the inclined interference surface 74, thus providing an interference fit.

As an alternate embodiment of the signal seal of the present invention, the internally threaded portion 36 of the fastener 34 includes a threaded portion 60 proximate to the flanges which comprises undersized threads. The undersized threads serve to bite the threads of the signal port with a metal to metal interference to create a locking effect which helps prevent the fastener from being disconnected. Thus, while the fastener is held in place, the signal seal is maintained due to the flange surfaces being held together.

As a further alternative embodiment, as shown in FIG. 1, the portion of undersized threads 60 are broached with a series of longitudinal grooves 62. The broached or upset threads are configured with a broach tool which is used to displace material. The tool may be cylindrical with longitudinally disposed cutting ridges. The ridges serve to displace or remove the material which they contact. The tool is inserted into the coupling nut such that the ridges of the tool contact the undersized threads and cut grooves across the threads. The material is displaced to the side of the thread, where it serves as a further interference contact with the mating thread of the signal port.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. A coaxial cable end connector comprising:

a tubular post having a first flange at a front end thereof and a cylindrical sleeve at a rear end thereof;

a tubular body supported on the front end of said post at a location adjacent to said first flange, said body defining a chamber which surrounds said cylindrical sleeve and which is adapted to engage a coaxial cable;

a port fastener rotatably supported on the front end of said post, said fastener having a second flange adapted to coact in mechanical interengagement with said first flange; and first means associated with said first and second flanges for establishing a first non-planar interface of interengagement which acts as a signal seal in response to said first and second flanges being interengaged.

2. The end connector of claim 1, wherein said first means comprises a first surface contour associated with said first flange which coacts with a second surface contour associated with said second flange.

3. The end connector of claim 2, wherein said first surface contour comprises a surface indentation and said second surface contour comprises a surface protuberance.

4. The end connector of claim 2, wherein said first surface contour comprises a surface protuberance and said second surface contour comprises a surface indentation.

5. The end connector of claim 2, wherein said first surface contour comprises a circumferential channel and said second surface contour comprises a circumferential ridge.

6. The end connector of claim 1, wherein said port fastener comprises a coupling nut with an internally threaded surface, said internally threaded surface including undersized threads proximate to said first and second flanges, said undersized threads creating a locking effect and enhancing said signal seal as said port fastener is threaded onto a signal port.

7. The end connector of claim 6, wherein said undersized threads are broached so as to create an additional interference fit with mating threads associated with said signal port.

8. The end connector of claim 1 further comprising second means associated with said port fastener and said tubular body for establishing a second non-planar interface of interengagement which acts as a signal seal in response to said port fastener being coupled to said signal port.

9. The end connector of claim 8, wherein said second means comprises a protuberance associated with said port fastener which coacts with an inclined surface associated with said tubular body as said port fastener is coupled to said signal port.

10. A coaxial cable end connector comprising:

a tubular post having a first flange at a front end thereof and a cylindrical sleeve at a rear end thereof;

a tubular body supported on the front end of said post at a location adjacent to said first flange, said body defining a chamber which surrounds said cylindrical sleeve and which is adapted to engage a coaxial cable;

a port fastener rotatably supported on the front end of said post, said fastener having a second flange adapted to coact in mechanical interengagement with said first flange, said fastener defining an internally threaded surface including an undersized threaded portion which creates a locking effect as said port fastener is threaded onto a signal port; and means associated with said first and second flanges for establishing a first non-planar interface of interengagement which acts as a signal seal in response to said first and second flanges being interengaged.

11. The end connector of claim 10, wherein said undersized threaded portion is broached so as to create an additional interference fit with mating threads associated with said signal port.

12. The end connector of claim 10, wherein said means for establishing a first non-planar interface comprises a first surface contour associated with said first flange which coacts with a second surface contour associated with said second flange.

13. The end connector of claim 12, wherein said first surface contour comprises a circumferential channel and said second surface contour comprises a circumferential ridge.

14. The end connector of claim 10 further comprising means associated with said port fastener and said tubular body for establishing a second non-planar interface of interengagement which acts as a signal seal in response to said port fastener being coupled to said signal port.

15. The end connector of claim 14, wherein said means for establishing a second non-planar interface comprises a protuberance associated with said port fastener which coacts with an inclined surface associated with said tubular body as said port fastener is coupled to said signal port.

16. A coaxial cable end connector comprising:

a tubular post having a first flange at a front end thereof and a cylindrical sleeve at a rear end thereof;

a tubular body supported on the front end of said post at a location adjacent to said first flange, said body defining a chamber which surrounds said cylindrical sleeve and which is adapted to engage a coaxial cable; and a port fastener rotatably supported on the front end of said post, said fastener having a second flange adapted to coact in mechanical interengagement with said first flange, said fastener defining an internally threaded surface including an undersized threaded portion which creates a locking effect as said port fastener is threaded onto a signal port, wherein said undersized threaded portion is broached so as to create an additional interference fit with mating threads associated with said signal port.

17. The end connector of claim 16 further comprising first means associated with said first and second flanges for establishing a first non-planar interface of interengagement which acts as a signal seal in response to said first and second flanges being interengaged.

18. The end connector of claim 17, wherein said first means comprises a first surface contour associated with said first flange which coacts with a second surface contour associated with said second flange.

19. The end connector of claim 18, wherein said first surface contour comprises a circumferential channel and said second surface contour comprises a circumferential ridge.

20. The end connector of claim 17 further comprising second means associated with said port fastener and said tubular body for establishing a second non-planar interface of interengagement which acts as a signal seal in response to said port fastener being coupled to said signal port.

21. The end connector of claim 20, wherein said second means comprises a protuberance associated with said port fastener which coacts with an inclined surface associated with said tubular body as said port fastener is coupled to said signal port.

* * * * *